US008561377B2

(12) United States Patent
Cirio

(10) Patent No.: US 8,561,377 B2
(45) Date of Patent: Oct. 22, 2013

(54) HEAD FOR APPLYING THREADED CAPS ON CONTAINERS

(75) Inventor: Sergio Cirio, Canelli (IT)

(73) Assignee: AROL, S.p.A., Canelli (Asti) (IT)

( * ) Notice: Subject to any disclaimer, the term of this patent is extended or adjusted under 35 U.S.C. 154(b) by 397 days.

(21) Appl. No.: 13/026,109

(22) Filed: Feb. 11, 2011

(65) Prior Publication Data

US 2012/0011809 A1 Jan. 19, 2012

(30) Foreign Application Priority Data

Jul. 13, 2010 (IT) ..... TO2010A0606

(51) Int. Cl.
*B67B 3/20* (2006.01)

(52) U.S. Cl.
USPC ..... 53/331.5

(58) Field of Classification Search
CPC ..... B67B 3/2086; B67B 3/2073; B67B 3/20; B65B 7/2835
USPC ..... 53/75, 317, 331.5
IPC ..... B67B 3/20
See application file for complete search history.

(56) References Cited

U.S. PATENT DOCUMENTS

| | | | | |
|---|---|---|---|---|
| 4,364,218 | A * | 12/1982 | Obrist | 53/331.5 |
| 4,599,846 | A * | 7/1986 | Ellis et al. | 53/331.5 |
| 5,490,369 | A | 2/1996 | Ellis et al. | |
| 6,240,678 | B1 * | 6/2001 | Spether | 53/317 |
| 2002/0184853 | A1 * | 12/2002 | Arrant et al. | 53/343 |
| 2009/0255214 | A1 * | 10/2009 | Schussler et al. | 53/331.5 |
| 2010/0077700 | A1 * | 4/2010 | DeLuca et al. | 53/331.5 |
| 2011/0167761 | A1 * | 7/2011 | Jha et al. | 53/317 |

FOREIGN PATENT DOCUMENTS

| | | | |
|---|---|---|---|
| DE | 297 00 135 | | 2/1997 |
| DE | 10058225 | A1 * | 5/2002 |
| EP | 636573 | A1 * | 2/1995 |
| EP | 1 405 819 | | 4/2004 |
| EP | 1 908 725 | | 4/2008 |
| JP | 09255089 | A * | 9/1997 |
| WO | WO 8602917 | A1 * | 5/1986 |

OTHER PUBLICATIONS

EP Search Report for Application No. 10192879.4-1261 dated Apr. 13, 2011, 2 pages.

* cited by examiner

*Primary Examiner* — Stephen F Gerrity

(74) *Attorney, Agent, or Firm* — Patterson & Sheridan, LLP

(57) ABSTRACT

A head for applying threaded caps to containers that are to be used in automatic machines for closing containers. The head may comprise a tubular bushing, a shaft that extends coaxially within the tubular bushing and that carries at a bottom end thereof an attachment for a cap gripping member, and a magnetic clutch set between the tubular bushing and the shaft.

9 Claims, 4 Drawing Sheets

HEAD FOR APPLYING THREADED CAPS ON CONTAINERS

CROSS-REFERENCE TO RELATED APPLICATIONS

This application claims benefit of Italian patent application serial number TO2010A000606, filed Jul. 13, 2010, which is herein incorporated by reference.

BACKGROUND OF THE INVENTION

1. Field of the Invention

The present invention relates to a head for applying threaded caps on containers that are to be used in automatic machines for closing containers.

More precisely, the invention regards a head comprising a tubular bushing, a shaft that extends coaxially within the tubular bushing and that carries at a bottom end thereof an attachment for a cap gripping member, and a magnetic clutch set between the tubular bushing and the shaft.

2. Description of the Related Art

Heads for applying threaded caps are known in which an adjustment ring-nut is provided set on the outside of the tubular bushing, in which the rotation of said ring-nut with respect to the tubular bushing enables variation of the distance in an axial direction between two mutually facing magnetic disks, which constitute a magnetic clutch that limits the maximum torque transmissible between the tubular bushing and the shaft carrying the cap gripping member.

SUMMARY OF THE INVENTION

In many technical fields, it is necessary to ensure that the application of caps to containers takes place in an aseptic environment. In these cases, it is necessary for the heads for application of the caps to be washable. To meet this requirement, it is necessary for the magnetic clutch to be isolated in a liquid-tight way from the external environment. It is moreover necessary to ensure that the adjustment of the torque transmissible by the magnetic clutch can be performed without exposing potentially contaminated areas.

The object of the present invention is to provide a head for applying caps that will enable the aforesaid requirements to be met.

According to the present invention, said object is achieved by a head for applying caps, the head having one or more of the following characteristics: a top body, having a longitudinal axis, an intermediate support, rotationally fixed with respect to the top body and axially mobile with respect to the top body in the direction of said longitudinal axis, elastic compression means, set between said top body and said intermediate support, a tubular bushing, fixed with respect to the intermediate support, a shaft, extending within said tubular bushing so that it shares said longitudinal axis, the shaft carrying at a bottom end thereof an attachment for a member for gripping the caps, a magnetic clutch, set between the tubular bushing and the shaft, wherein the magnetic clutch comprises a first magnet and a second magnet, said magnets being set within said tubular bushing and having respective surfaces facing, and set at a distance from, one another, wherein the first magnet is fixed with respect to the shaft and the second magnet is rotationally fixed with respect to the tubular bushing and can be adjusted axially in the direction of said longitudinal axis, a magnet support, fixed to the second magnet, the magnet support being rotationally fixed and axially mobile with respect to the tubular bushing, the magnet support having an external thread; and an adjustment ring, set on the outside of the tubular bushing, the adjustment ring being axially fixed with respect to the tubular bushing and being able to turn about said longitudinal axis, the adjustment ring having an internal thread that engages said external thread of the magnet support.

A further object of the present invention is to provide a head for applying threaded caps that will enable replacement in a simple and fast way of the springs that press elastically in an axial direction on the supporting bushing so as to change the axial force with which the caps are pressed on the containers.

BRIEF DESCRIPTION OF THE DRAWINGS

The characteristics and advantages of the head according to the present invention will emerge clearly in the course of the ensuing detailed description, which is provided purely by way of non-limiting example, with reference to the attached drawings, in which.

DETAILED DESCRIPTION

Figure 1:
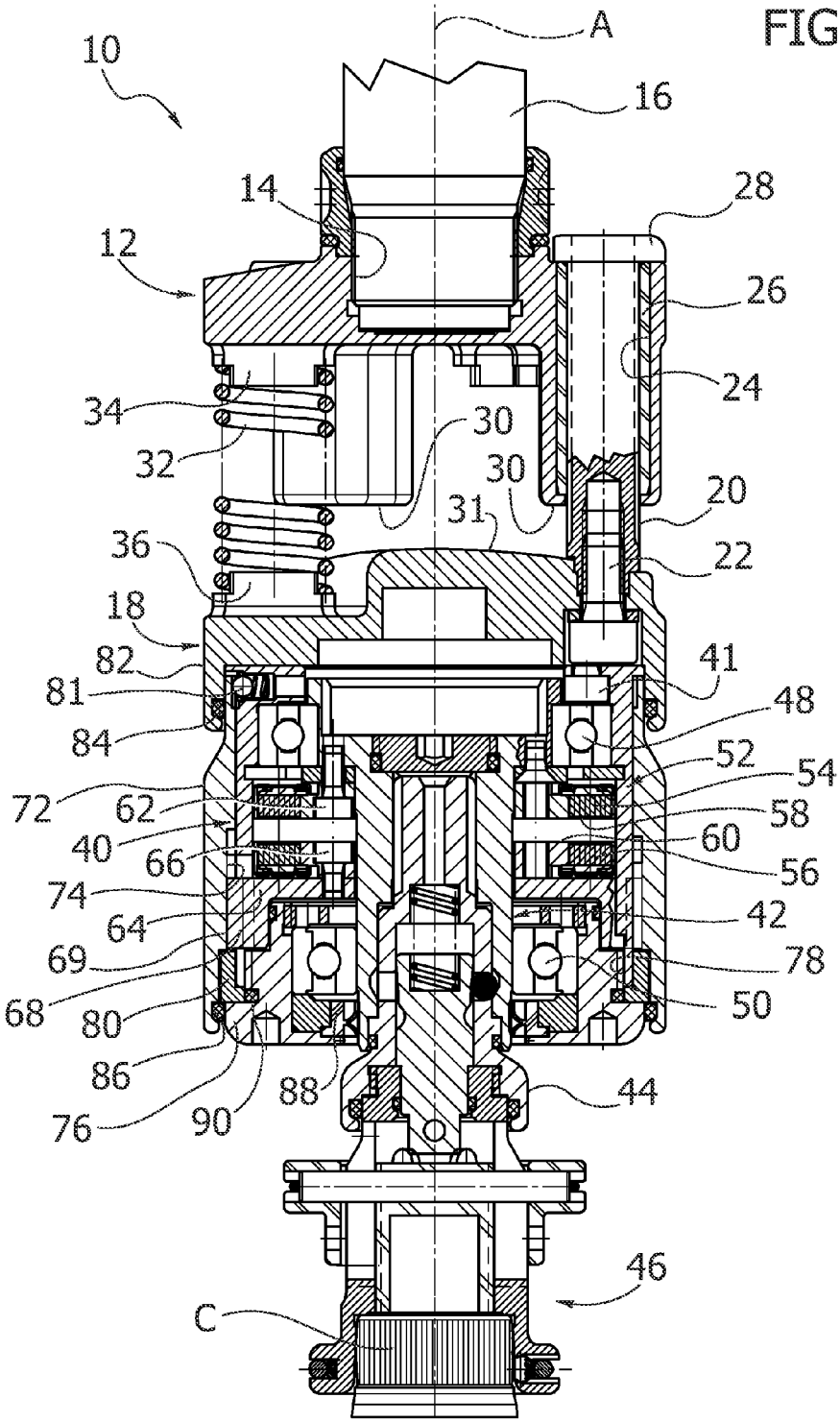
FIG. 1 is an axial cross section of a head according to the present invention.
Figure 2:
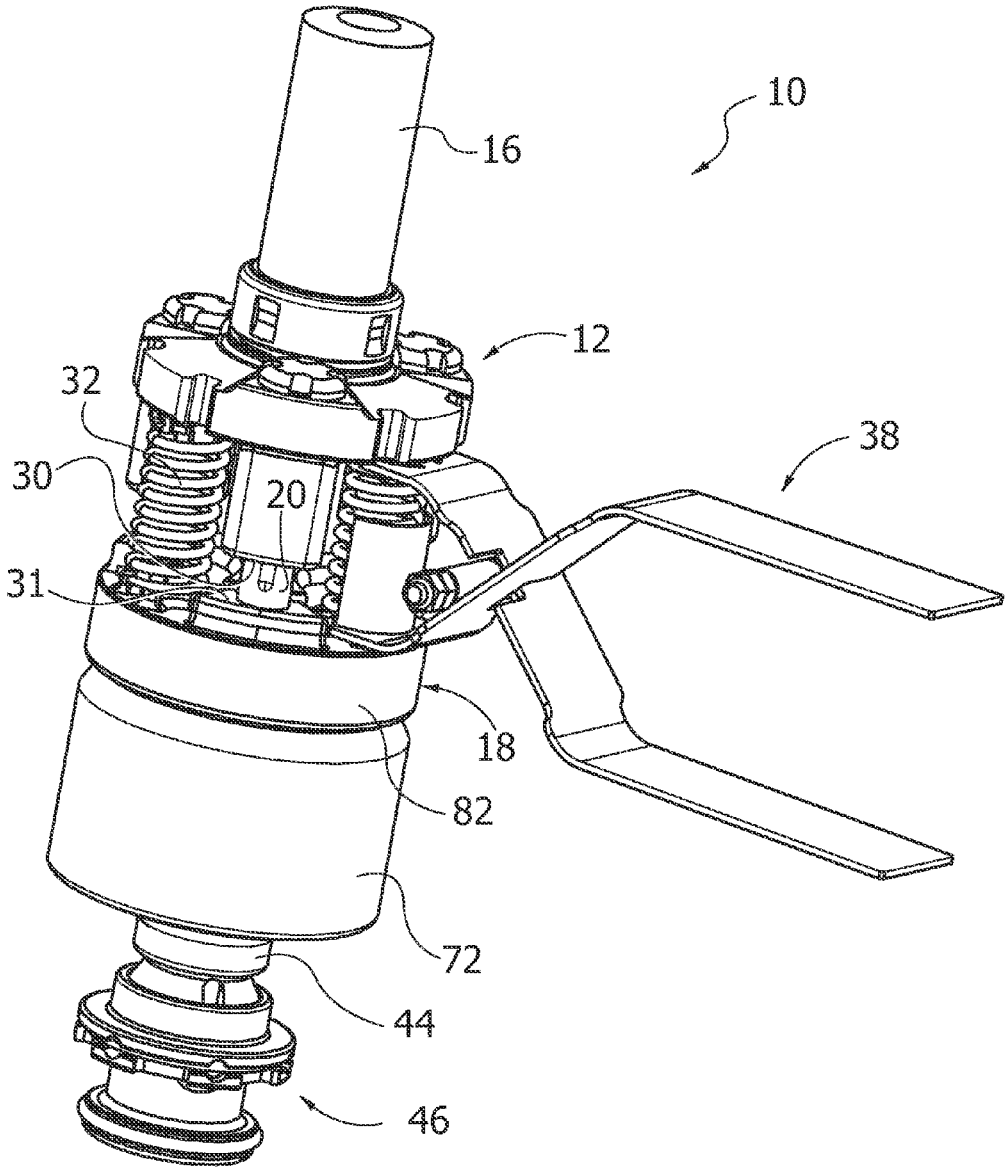
FIG. 2 is a perspective view of the head of FIG. 1 with an accessory tool for the replacement of the springs of the head.
Figure 3:
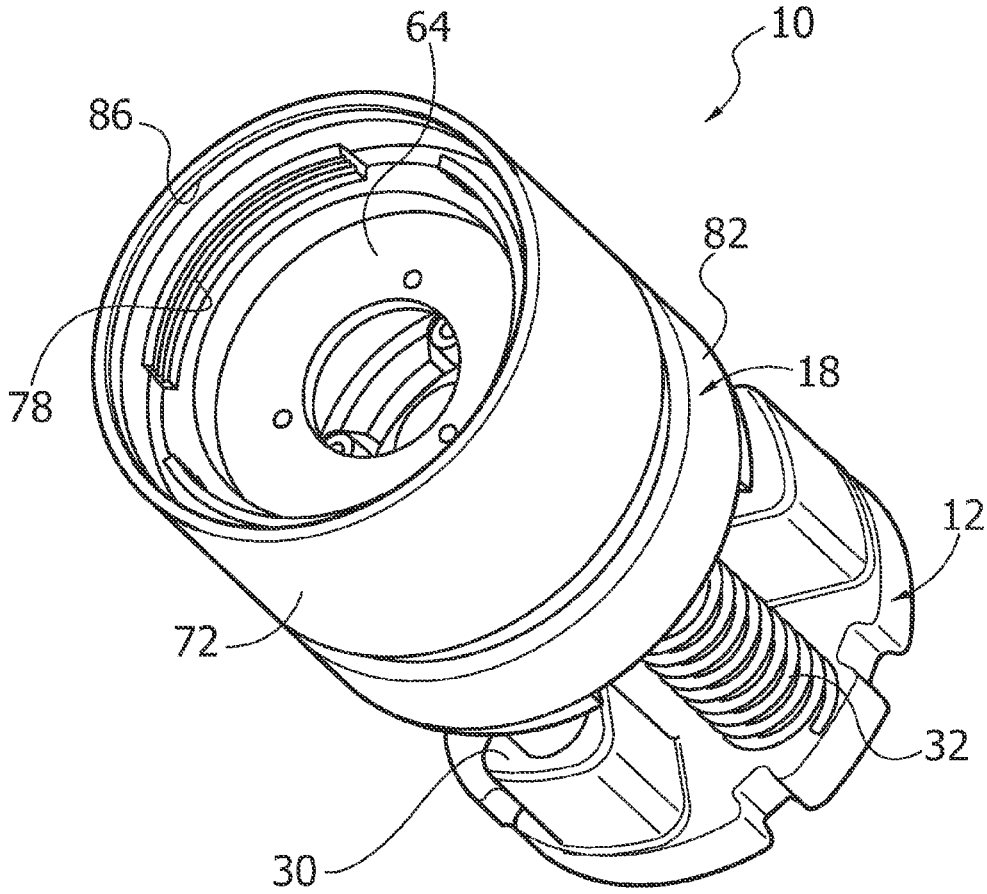
FIGS. 3 and 4 are perspective views of the head of FIG. 1 with some components removed.

With reference to FIGS. 1 and 2, designated by 10 is a head for applying threaded caps on containers.

The head 10 comprises a top body 12 having a threaded hole 14, by means of which the top body 12 is directly fixed to the bottom end of a spindle 16 that is able to turn about a longitudinal axis A.

In the sequel of the description and in the claims the terms "top" and "bottom" refer to the normal position of use of the head 10, in which the longitudinal axis A is vertical.

The spindle 16 forms part of an automatic machine for applying threaded caps on containers. In operation, the spindle 16 is actuated with a movement of rotation about the longitudinal axis A and with a simultaneous movement of translation along said longitudinal axis A. The movements of rotation and translation are co-ordinated with respect to one another so as to obtain a helical movement of the spindle 16. The way in which the movement of roto-translation of the spindle 16 is generated can be considered conventional and lies outside the scope of the present invention.

The head 10 comprises an intermediate support 18, which is rotationally fixed with respect to the top body 12 and is mobile with respect to the top body 12 in the direction of the longitudinal axis A. The intermediate support 18 is connected to the top body by means of a plurality of guide columns 20 (only one of which is visible in FIG. 1), parallel to the longitudinal axis A. Each guide column 20 has a bottom end fixed to the intermediate support 18, for example by means of a screw 22, and slidably engages a guide hole 24 of the top body 12, possibly with the interposition of a bushing 26. Each guide column 20 has a top head 28, which rests on a front edge of the respective guide hole 24 to constrain the intermediate support 18 axially to the top body 12 in a position of maximum distance between the intermediate support 18 and the supporting body 12. The bottom front ends 30 of the guide holes 24 constitute arrest surfaces that come to bear upon a top surface 31 of the intermediate support 18 in a position of minimum distance between the top body 12 and the intermediate support 18.

A plurality of helical compression springs 32 pushes elastically the intermediate support 18 downwards towards the position of maximum relative distance between the top body 12 and the intermediate support 18.

Each helical spring 32 has its opposite ends engaged on respective short pins 34, 36, aligned with respect to one another and projecting in opposite directions respectively from the top body 12 and the intermediate support 18. The helical springs 32 push the intermediate support 18 towards the position of maximum distance from the top body 12. When the supporting body 18 is subjected to a force directed upwards, the springs 32 are compressed and allow a movement of approach of the intermediate support 18 with respect to the top body 12 in the direction of the axis A.

The pins 34, 36 that engage the ends of the springs 32 have a limited extension in the axial direction. The free gap between the pins 34, 36, with the top body 12 and the intermediate support 18 at the maximum relative distance, is greater than the length of the spring 32 in the compressed position. Thanks to this, it is possible to carry out conveniently replacement of the springs 32 with springs having a different stiffness without having to dismantle the head 10. In order to replace the springs 32 a pair of pliers designated by 38 in FIG. 2 can be used, which enables axial compression of a spring 32 until the ends of the spring are disengaged from the pins 32, 34. The new springs can be mounted using the same pair of pliers 38.

Figure 4:
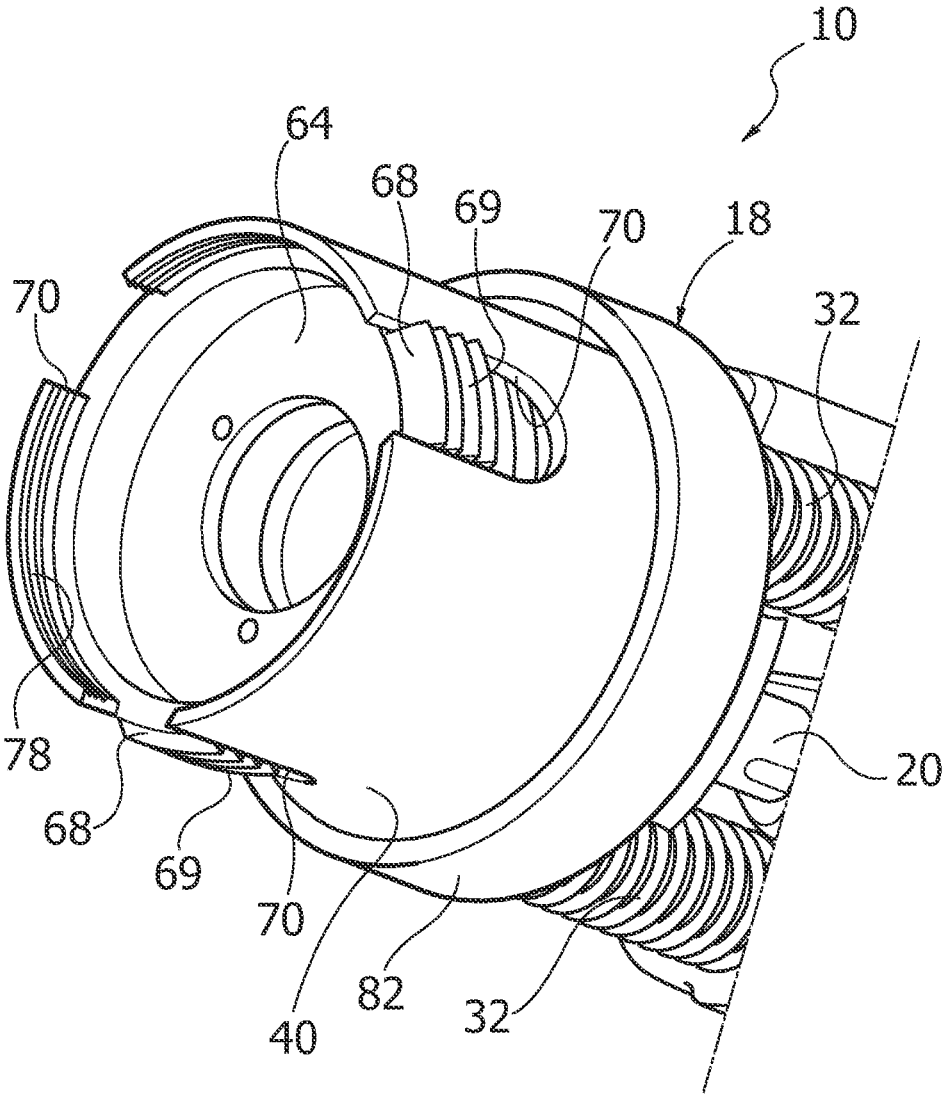

With reference to FIGS. 1 and 4, the head 10 comprises a tubular bushing 40 having a longitudinal axis coinciding with the axis of rotation A of the spindle 16. The tubular bushing 40 is fixed to the intermediate support 18, for example by means of screws 41, only one of which is partially visible in FIG. 1.

With reference to FIG. 1, housed within the tubular bushing is a shaft 42 coaxial with respect to the tubular bushing 40. The shaft 42 is connected to the tubular bushing 40 so that it can turn about the axis A by means of two roller bearings 48, 50. The shaft 42 carries at a bottom end thereof an attachment 44, engaged to which is a gripping member 46 designed to grip threaded caps C (FIG. 1) that are to be screwed on the tops of containers.

With reference to FIG. 1, the head 10 comprises a magnetic clutch 52, comprising a top magnet 54 and a bottom magnet 56 shaped like disks, with respective front surfaces 58, 60 facing, and set at a distance from, one another in the direction of the axis A. Alternatively, the magnets 54, 56 can have concentric lateral surfaces set at a distance from one another in the direction of the longitudinal axis A. The magnets 54, 56 are contained within the tubular bushing 40. The top magnet 54 is fixed to the shaft 42, for example by means of screws 62.

With reference to FIGS. 1 and 4, the bottom magnet 56 is fixed to a magnet support 64, for example by means of screws 66. The magnet support 64 is provided with radial projections 68, which extend through respective through openings 70 formed in the tubular bushing 40. The radial projections 68 have an external thread 69 coaxial to the longitudinal axis A (FIG. 4), formed on a cylindrical surface set outside the tubular bushing 40.

The through openings 70 are elongated in a longitudinal direction and function as a guide for the radial projections 68. The radial projections 68 are constrained in a rotational direction with respect to the through openings 70 and are free to move in a longitudinal direction with respect to the through openings 70. Consequently, the magnet support 64 and the bottom magnet 56 fixed thereto are rotationally fixed with respect to the tubular bushing 40 and are free to perform a movement of adjustment with respect to the tubular bushing 40 in the direction of the longitudinal axis A.

The head 10 comprises an adjustment ring 72 set on the outside of the tubular bushing 40. The adjustment ring 72 is constrained axially with respect to the tubular bushing 40 and is able to turn about the longitudinal axis A. The adjustment ring 72 has an internal thread 74 that engages the external thread 69 of the radial projections 68.

A lid 76 is screwed in an internal thread 78 of the tubular bushing 40. The lid 76 constrains the adjustment ring 72 axially with respect to the tubular bushing 40. The adjustment ring 72 rests axially on the lid 76 via a spacer ring 80. The top end of the adjustment ring 72 rests against an outer edge of the tubular bushing 40. It will be understood that with this arrangement the adjustment ring 72 is free to turn about the axis A but is axially constrained with respect to the tubular bushing 40.

The rotation of the adjustment ring 72 about the axis A causes, via coupling of the threads 69, 74, a movement in an axial direction of the magnet support 64 and of the bottom magnet 56 fixed thereto. Said movement enables adjustment of the axial distance between the magnets 54, 56 and, consequently, the maximum torque transmitted by means of the magnetic clutch 52 from the tubular bushing 40 to the shaft 42.

With reference to FIG. 1, there may be provided a snap-action retention device including a ball 81, elastically pushed against positioning notches formed on the inner surface of the adjustment ring 72 so as to obtain a snap-action movement of the adjustment ring 72.

The top end of the adjustment ring 72 is inserted within an annular edge 82 of the intermediate support 18. A first sealing element 84 is set between the annular edge 82 and the adjustment ring-nut 72. A second sealing element 86 is set between a bottom end of the adjustment ring 72 and the lid 76. A third sealing element 88 is set between the lid 76 and the shaft 42. There may also be provided a fourth sealing element 90, set between the ring 80 and the lid 76. The first, second, and fourth sealing elements are preferably constituted by an O-ring, and the third sealing element is preferably constituted by a lip seal.

The arrangement illustrated enables isolation, in a liquid-tight way, from the external environment, of the part of the head 10 that contains the magnetic clutch 52 and the bearings 48, 50.

This characteristic of impermeability, which is improved as compared to the known solutions, is particularly appreciated in the packaging sector, especially in an aseptic environment. The clutch assembly, in addition to guaranteeing tightness in regard to jets of liquids (from outside inwards, and vice versa) is extremely compact and clean. Hygiene is guaranteed by the fact that in order to regulate the torque it is not necessary to raise or displace pieces (thus exposing potentially dirty parts) but it is sufficient to turn the ring-nut 72 manually. The O-rings 80, 86 are mounted in open seats and are hence readily washable.

The top body 12, the intermediate support 18, and the guide columns 20 are designed so as to ensure a high level of hygiene, for example by providing vertical draining grooves in the guide columns 20, inclined surfaces of the top body 12 and of the intermediate support 18 and drain channels in the pins 34 where the springs 32 are anchored. The fast replacement of the springs, a feature that is particularly appreciated by customers, does not require dismantling of any item but simple vertical compression using a special pair of pliers operated manually.

Of course, without prejudice to the principle of the invention, the details of construction and the embodiments may vary widely with respect to what has been described and illustrated herein, without thereby departing from the scope of the present invention, as defined by the ensuing claims.

The invention claimed is:

1. A head for applying threaded caps to containers, comprising:

a top body having a longitudinal axis;

an intermediate support, rotationally fixed with respect to the top body and axially mobile with respect to the top body in the direction of said longitudinal axis;

elastic compression elements, set between said top body and said intermediate support;

a tubular bushing, fixed with respect to the intermediate support;

a shaft, extending coaxially to said longitudinal axis within said tubular bushing, the shaft carrying at a bottom end thereof an attachment for a member for gripping the caps;

a magnetic clutch, set between the tubular bushing and the shaft, wherein the magnetic clutch comprises a first magnet and a second magnet, said magnets being set within said tubular bushing and having respective surfaces facing, and set at a distance from, one another, wherein the first magnet is fixed with respect to the shaft and the second magnet is rotationally fixed with respect to the tubular bushing and can be adjusted axially in the direction of said longitudinal axis;

a magnet support, fixed to the second magnet, the magnet support being rotationally fixed and axially mobile with respect to the tubular bushing, the magnet support having an external thread;

an adjustment ring set outside the tubular bushing, the adjustment ring being axially fixed with respect to the tubular bushing and being able to turn about said longitudinal axis, the adjustment ring having an internal thread that engages said external thread of the magnet support.

2. The head according to claim 1, wherein the tubular bushing has a side wall with a plurality of through openings elongated in a longitudinal direction and wherein the magnet support has a plurality of radial projections that extend through said through openings of said tubular bushing and are guided in said through openings in the direction of said longitudinal axis.

3. The head according to claim 1, wherein a lid is fixed to a bottom end of the tubular bushing, said lid axially constraining the adjustment ring-nut to the tubular bushing.

4. The head according to claim 3, wherein a second sealing element is set between a bottom end of said adjustment ring and said lid.

5. The head according to claim 3, wherein a third sealing element is set between said lid and said shaft.

6. The head according to claim 1, wherein a first sealing element is set between an annular edge of said intermediate support and a top end of said adjustment ring.

7. The head according to claim 1, wherein said intermediate support and said top body are rotationally connected to one another by means of a plurality of guide columns parallel to said longitudinal axis and slidable within respective guide holes.

8. The head according to claim 7, wherein a plurality of helical compression springs is set between said intermediate support and said top body, each of said springs engaging at its ends short pins, projecting axially from said top body and from said intermediate support.

9. The head according to claim 1, wherein said magnets have respective front surfaces facing one another and set at a distance in the direction of said longitudinal axis.

* * * * *